US005217322A

United States Patent [19]

Corcoran et al.

[11] Patent Number: 5,217,322

[45] Date of Patent: * Jun. 8, 1993

[54] TOOTH FOR COMPACTOR WHEEL

[75] Inventors: Paul T. Corcoran, Washington; David O. Philips, Metamora, both of Ill.

[73] Assignee: Caterpillar Inc., Peoria, Ill.

[ * ] Notice: The portion of the term of this patent subsequent to Jun. 8, 2010 has been disclaimed.

[21] Appl. No.: 812,541

[22] Filed: Dec. 23, 1991

[51] Int. Cl.[5] ..... E01C 19/26

[52] U.S. Cl. ..... 404/121; 404/124; 172/554; 301/44.1

[58] Field of Search ..... 404/121, 124; 301/41 R, 301/43, 44 R; 172/540, 554, 713, 719

[56] References Cited

U.S. PATENT DOCUMENTS

H946 8/1991 Lonn ..... 404/121

3,318,211 5/1967 Grace ..... 404/124

*Primary Examiner*—William P. Neuder

*Attorney, Agent, or Firm*—J. W. Burrows

[57] ABSTRACT

Teeth for compactors are normally utilized to crush and/or grind refuse material and/or soil being worked and to effectively compact the refuse material and/or soil being worked. It is also advantageous to insure that the teeth being used provide traction of the compactor wheel on the materials being worked while not allowing the refuse material and/or soil to collect between the teeth of the compactor wheel. In the subject arrangement, the tooth provides a tip portion having an outer surface with at least six edges and a plurality of corresponding side surfaces extending therefrom at an obtuse angle with respect to the outer surface. The tooth defines a longitudinal plane therethrough that is parallel to the length of the tooth and perpendicular to the outer surface. Two of the side surfaces lie perpendicular to the longitudinal plane and form obtuse angles with the outer surface in the range of 115 degrees to 135 degrees. The angle of the two side surfaces with respect to the outer surface and the angle of the plurality of other sides with respect to the outer surface provides a tooth that effectively penetrates the refuse material and/or soil being worked, crushes and/or compacts the refuse material and/or soil being worked while providing sufficient traction for the compacting wheel thereon.

23 Claims, 5 Drawing Sheets

5/5

TOOTH FOR COMPACTOR WHEEL

TECHNICAL FIELD

This invention relates generally to a tooth for a compactor wheel and more particularly to the profile of the tooth.

BACKGROUND ART

Compacting wheels are normally used in landfill operations to grind and/or crush and compact refuse materials to reduce the size and bulk of the refuse materials followed by compacting soil over the compacted refuse materials. It is desirable to have a tooth arrangement on compactor wheels that can readily penetrate the material being ground and/or crushed and to compact the material simultaneously while still providing good traction for the compactor wheel of the compacting machine. U.S. Pat. No. 4,919,566 issued Apr. 24, 1990 to J. O. Caron, teaches an arrangement having a plurality of teeth to provide traction and a second plurality of teeth to provide the grinding and/or crushing and compaction of the materials. It is also desirable in compactor wheels to have an arrangement of teeth thereon that resist any tendency of soil and/or other debris to build-up between the respective teeth. Consequently, it is beneficial to limit the number of teeth on the compactor wheel in order to minimize the tendency of refuse material and/or soil to collect between the teeth. U.S. Pat. No. 4,074,942 which issued Feb. 21, 1978 to T. E. Cochran, teaches a tooth which has an outer profile configured in a "plus" shape. The portion of the "plus" shape that is aligned parallel to the direction of travel of the wheel provides the crushing and/or grinding and compacting of the refuse material and/or soil while the portion of the "plus" shape that is transverse to the direction of travel of the wheel provides the traction of the wheel on the refuse material and/or soil being worked. The total exterior profile of the tooth functions to compact the material being worked. In many instances, however, the above noted arrangements may disturb the surface of the refuse material and/or soil due to the entry and exit of the tooth during operation which may lead to erosion of the refuse material and/or soil by wind and/or rain. By having the grinding and/or crushing, the compacting, and the traction functions all on the same tooth, the number of teeth on the circumference of the wheel can be reduced, thus further reducing the possibility of refuse material and/or soil collecting between the respective teeth.

It is desirable to provide a tooth that readily penetrates the refuse material being worked, crushes and/or grinds the refuse material and simultaneously compacts the refuse material while still providing good traction of the compactor wheel on the materials being worked without disturbing the surface of the refuse material and/or soil. It is likewise desirable to provide a tooth for use on the compactor wheel that requires a smaller number of teeth per wheel, thus reducing the tendency of refuse material and/or soil collecting between the teeth.

The present invention is directed to overcoming one or more of the problems as set forth above.

DISCLOSURE OF THE INVENTION

In one aspect of the present invention, a tooth is provided and adapted for use on a wheel of a compactor. The tooth includes a body portion and a tip portion.

The body portion has a base with a predetermined length and width and defines a longitudinal plane parallel to the length of the base. The tip portion has an outer surface with at least six edges connected one to the other to form obtuse angles therebetween. The tip portion is spaced outwardly from the base. The at least six edges has a pair of opposed edges and a plurality of other edges. Each edge of the pair of opposed edges being spaced from the other a predetermined distance and perpendicular with the longitudinal plane. A plurality of side surfaces extends at an obtuse angle relative to the outer surface one from each edge of the at least six edges towards the base.

The present invention provides a simple tooth which due to its outer profile readily penetrates the material being worked, compacts, crushes and/or grinds the material while still maintaining good traction of the compactor wheel on the material without disturbing the surface of the refuse material and/or soil. Furthermore, the outer profile of the tooth and the lesser number of teeth required per compactor wheel reduces the tendency of any refuse material and/or soil collecting between the teeth.

BEST MODE FOR CARRYING OUT THE INVENTION

Figure 1:
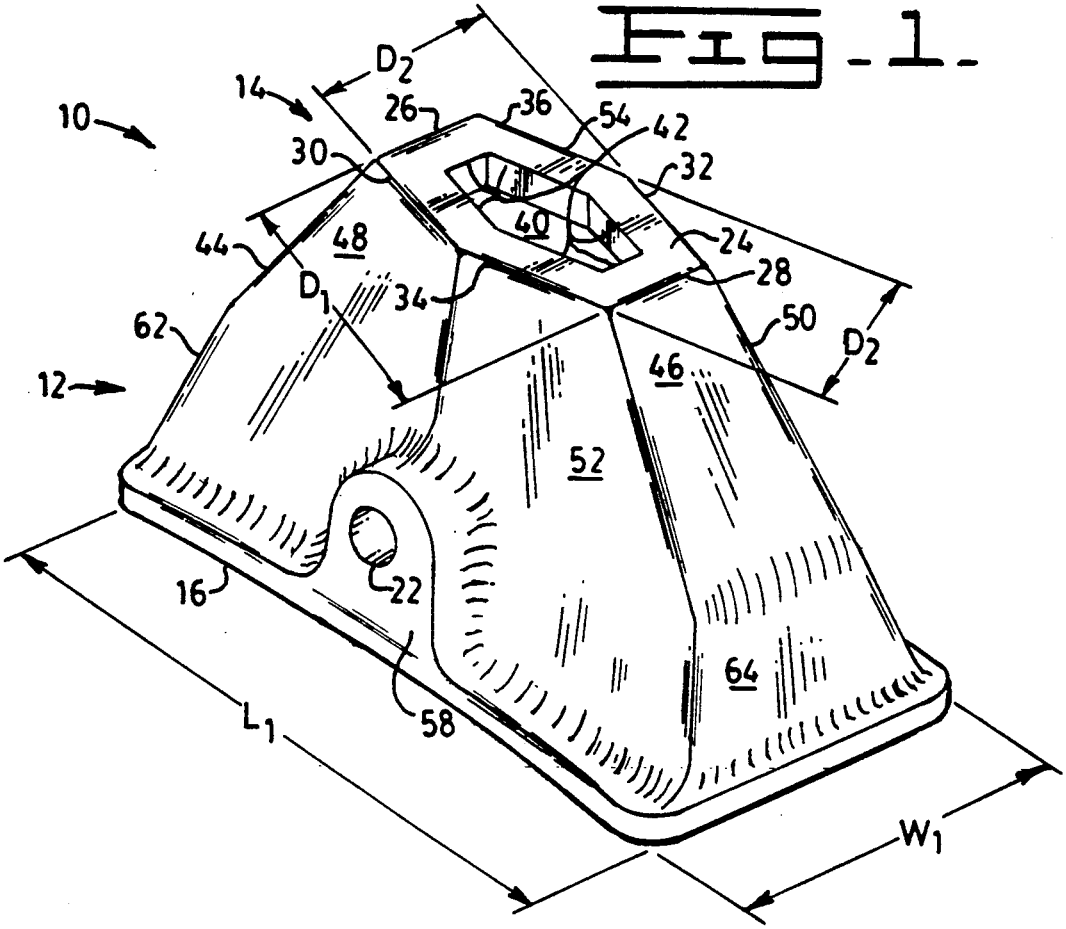
FIG. 1 is an isometric drawing representing an embodiment of the present invention.
Figure 2:
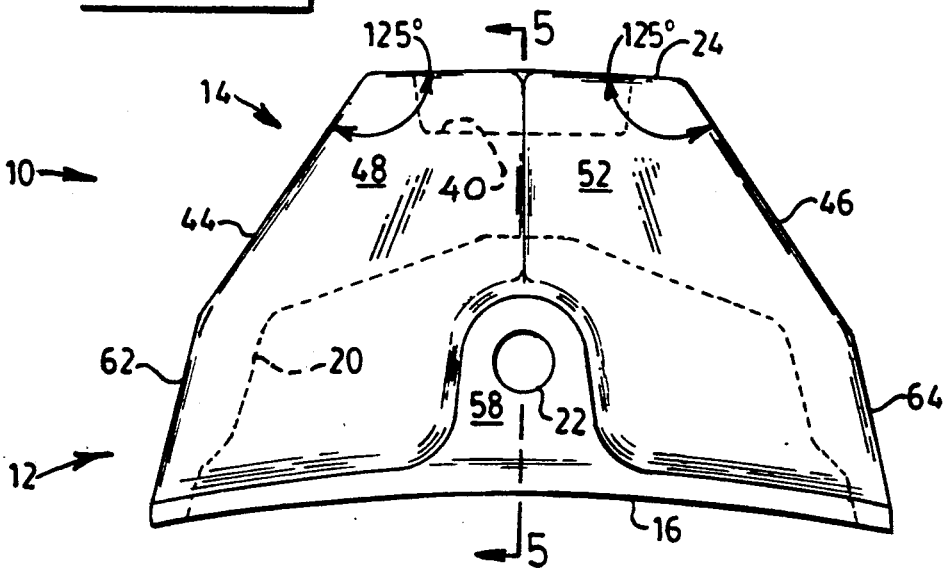
FIG. 2 is a side view of the tooth illustrated in FIG. 1.
Figure 3:
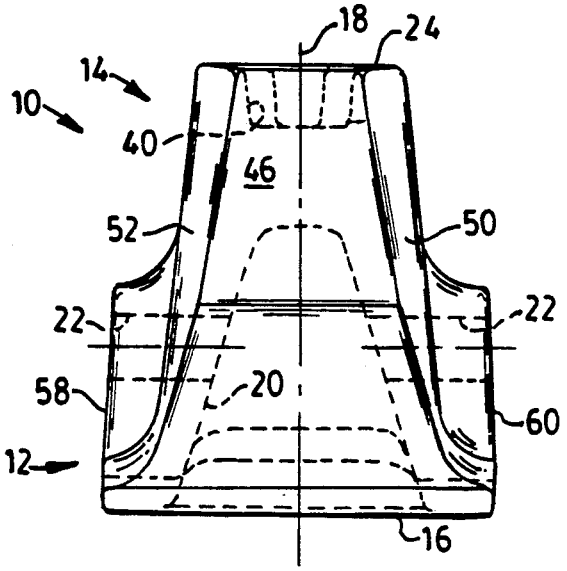
FIG. 3 is an end view of the tooth illustrated in FIG. 1.
Figure 5:
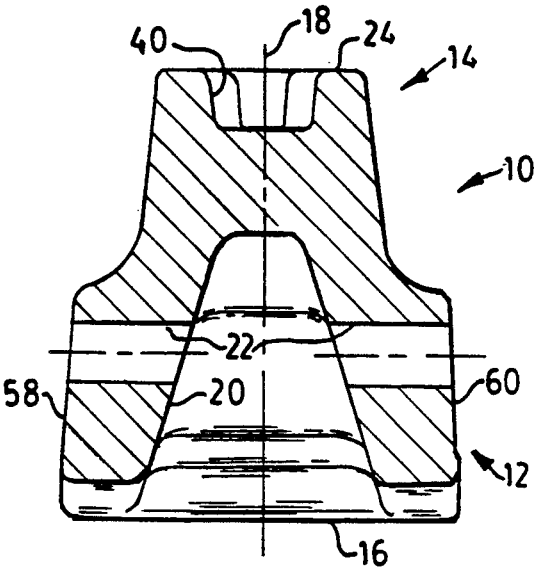
FIG. 5 is a cross-sectional view taken along the line 5—5, of FIG. 2.
Figure 4:
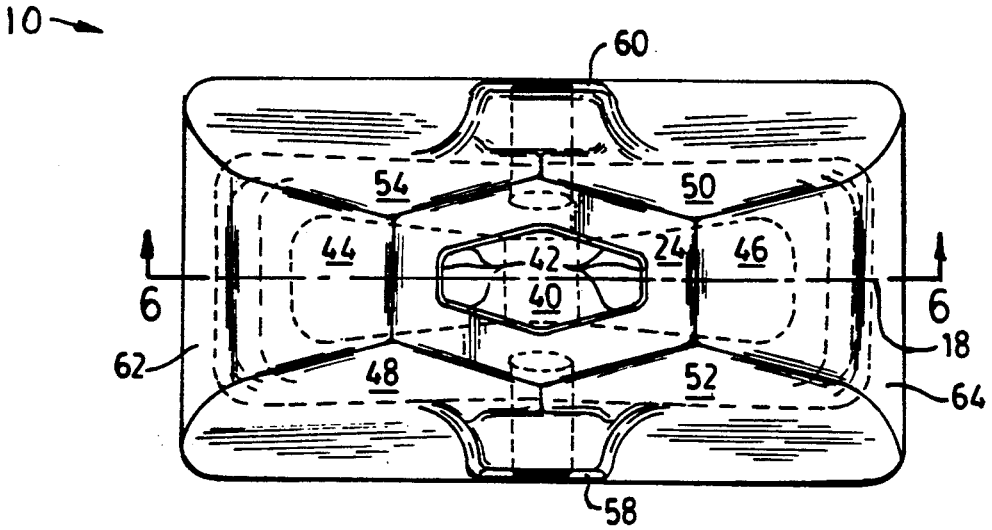
FIG. 4 is a top view of the tooth illustrated in FIG. 1.
Figure 6:
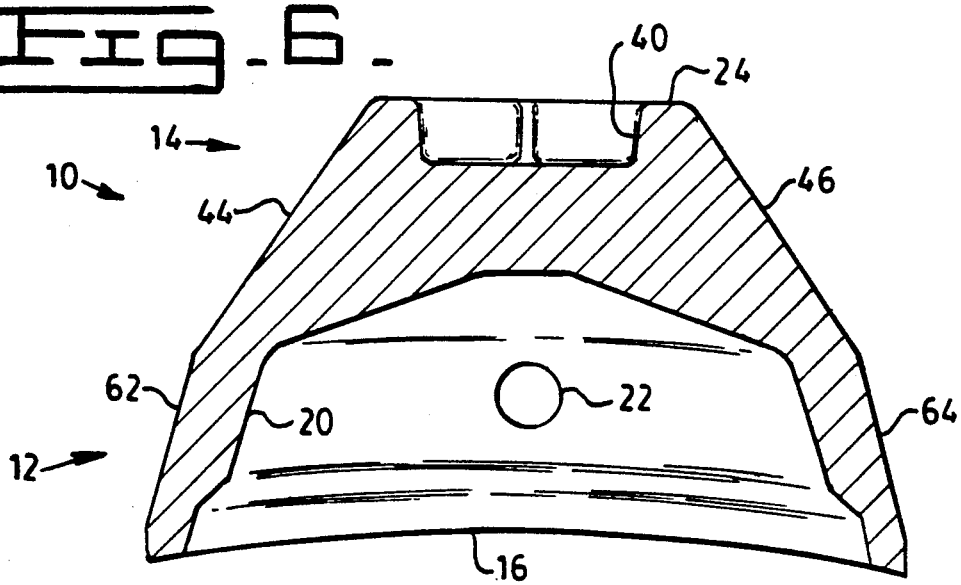
FIG. 6 is a cross-sectional view taken along the line 6—6 of FIG. 4.

Referring to FIGS. 1–6 of the drawings, a tooth 10 is illustrated. The tooth 10 includes a body portion 12 and a tip portion 14. The body portion 12 has a base 16 with a predetermined length $L_1$ and a predetermined width $W_1$. A longitudinal plane 18 is defined in the tooth 10 parallel with the length $L_1$ of the base 16 and generally perpendicular to the base 16. The base 16 of the subject embodiment is generally rectangular in shape. A cavity 20 is defined in the body portion 12 and extends inwardly from the base 16. The cavity 20 is adapted to mate with an adapter on the compactor wheel so that the tooth 10 can be readily removed and replaced. It is recognized however that the tooth 10 could be welded to the wheel of the compactor without departing from the essence of the invention. A pair of aligned holes 22 are defined in the body perpendicular to the longitudinal plane 18 and each hole of the pair of aligned holes 22 is disposed on opposite sides of the cavity 20.

The tip portion 14 has an outer surface 24 that is spaced outwardly from the base 16. The outer surface 24 has at least six edges 26,28,30,32,34,36 connected one to the other t form obtuse angles therebetween. The at least six edges has a pair of opposed edges 26,28 and a plurality of other edges 30,32,34,36. The pair of opposed edges 26,28 is spaced from each other a predetermined distance $D_1$ and each edge of the pair of edges 26,28 is oriented perpendicular with the longitudinal plane 18. The plurality of other edges 30,32,34,36 has a second pair of opposed edges 30,32 spaced from each other at a second predetermined distance $D_2$ and a third pair of opposed edges 34,36 spaced from each other at a distance equal to the second predetermined distance $D_2$. The second and third pairs of edges 30,32,34,36 form an angle with the direction of travel of the compactor wheel that is less than 90 degrees. The second predetermined distance $D_2$ is less than the first predetermined distance $D_1$. However it is recognized that distances $D_1$ and $D_2$ could be equal.

A recess 40 is defined in the tip portion 14 and extends inwardly from the outer surface 24. The recess 40 has the same shape as the outer surface 24 and is centrally disposed in the outer surface 24. A plurality of additional edges 42 are defined on the outer surface 24 adjacent the recess 40. Respective ones of the additional plurality of edges 42 are parallel to the corresponding edge of the outer surface 24 and spaced equal distances therefrom.

Respective edges of the at least six edges 26,28,30,32,34,36 have corresponding side surfaces 44,46,48,50,52,54 extending therefrom at obtuse angles relative to the outer surface 24.

The side surfaces 44,46 which extend from the first pair of opposed edges 26,28 extend therefrom at an obtuse angle with respect to the outer surface 24 in the range of 115 degrees to 135 degrees and preferably in the range of 120 degrees to 130 degrees. In the subject embodiment, the angle thereof is 125 degrees.

Additional side surfaces 58,60 extend outwardly from the base 16 and are oriented generally parallel to the longitudinal plane 18 and perpendicular with the outer surface 24. In the subject embodiment illustrated in FIGS. 1–6, the additional side surfaces 58,60 are shown as having draft angles provided thereon for manufacturing purposes. The additional side surfaces 58,60 are considered as being perpendicular to the outer surface 24 without departing from the essence of the invention even though the additional side surfaces 58,60 are illustrated as having draft angles. Likewise draft angles could be provided on all surfaces as needed for manufacturing purposes. Draft angles are normally in range of 5–7 degrees and extend both directions from the parting line of the forging die or the casting mold. The additional side surfaces 58,60 are generally located midway along the longitudinal length $L_1$ of the tooth 10 and have a predetermined length that is less than the length $L_1$ of the base 16 and preferably less than one fourth the length $L_1$ of the base 16. The height of the additional side surfaces 58,60 extends from the base 16 towards the outer surface 24 for a distance less than half the distance between the base 16 and the outer surface 24. The height of the additional side surfaces 58,60 is such that the pair of aligned holes 22 separated by the cavity 20 extend therebetween.

Yet additional side surfaces 62,64 extend generally from the base 16 towards the outer surface 24. The yet additional side surfaces 62,64 intersect respective ones of the side surfaces 44,46 extending from the first pair of opposed edges 26,28 and are oriented with respect to the outer surface 24 by an obtuse angle that is smaller than the angle formed between the outer surface 24 and the side surfaces 44,46 extending from the first pair of opposed edges 26,28. The yet additional side surfaces 62,64 are oriented perpendicular with the longitudinal plane 18 and intersect the side surfaces 44,46 extending from the first pair of opposed edges 26,28.

Figure 7:
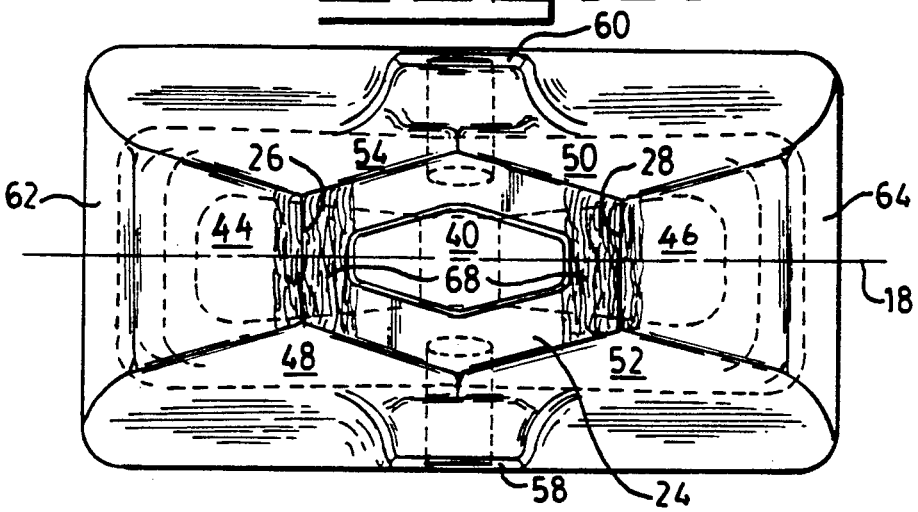
FIG. 7 is a top view of another embodiment of the tooth illustrating a modified version of the tooth illustrated in FIG. 1.

Referring now to FIG. 7, another embodiment of the present invention is illustrated. The embodiment of FIG. 7 is basically the same as the embodiment as set forth in FIGS. 1–6 above and differs only in that a hard particle material 68 is bonded to a portion of the outer surface 24 and the side surfaces 44,46 that extend from the first pair of opposed edges 26,28. The hard particle material 68 located on the outer surface 24 begins at the respective edges of the first pair of edges 26,28 and extend inwardly thereof to a point adjacent the recess 40. The hard particle material 68 extends from the respective edges of the first pair of edges 26,28 inwardly on the side surfaces 44,46 that extend therefrom a short distance, for example, 3 to 7 mm. It is recognized that the hard particle material 68 could be applied by various forms of welding processes or a slot could be provided in the tip portion 14 adjacent the outer surface 24 in order for a hard particle material insert to be bonded thereto without departing from the essence of the invention. Furthermore, the hard article material could be cast into the outer surface 24.

Figure 8:
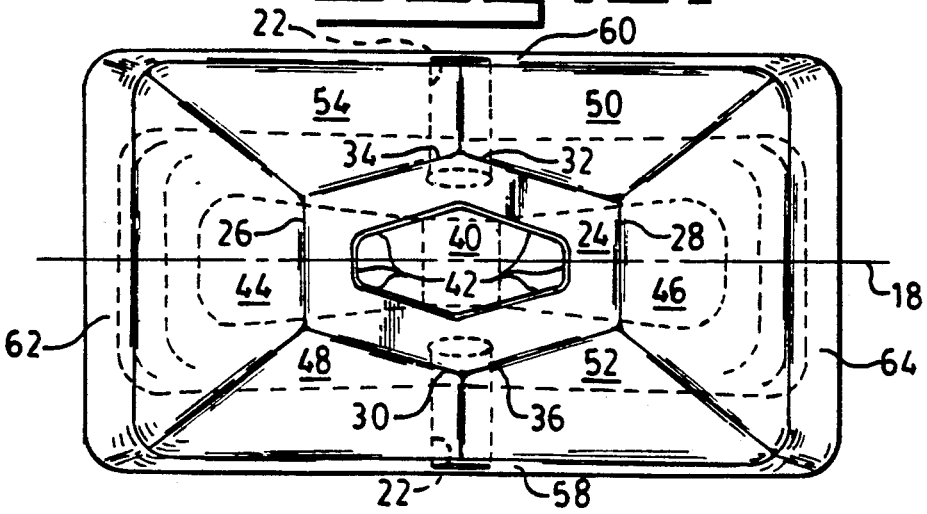
FIG. 8 is a top view of another embodiment of the present invention.
Figure 9:
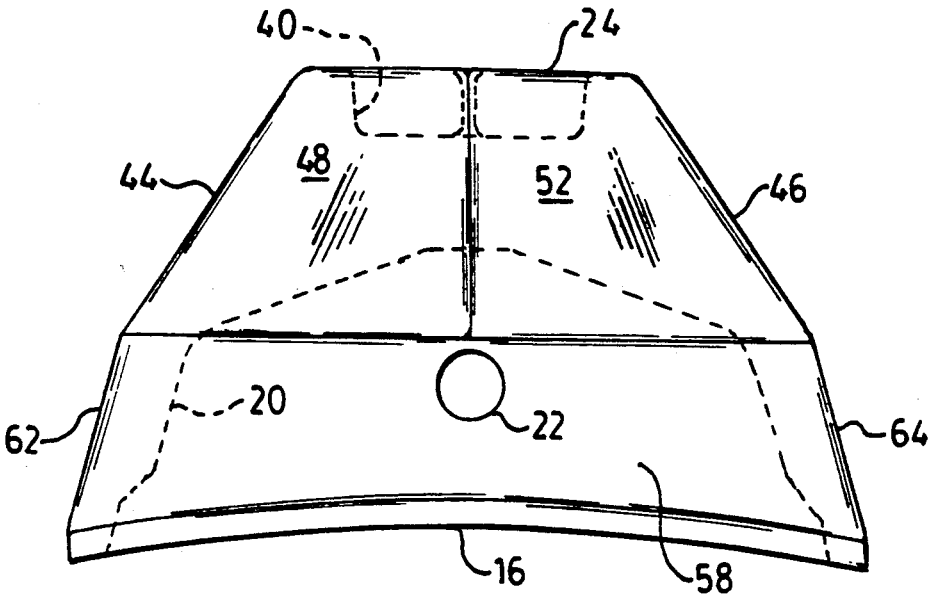
FIG. 9 is a side view of the tooth illustrated in FIG. 8.
Figure 10:
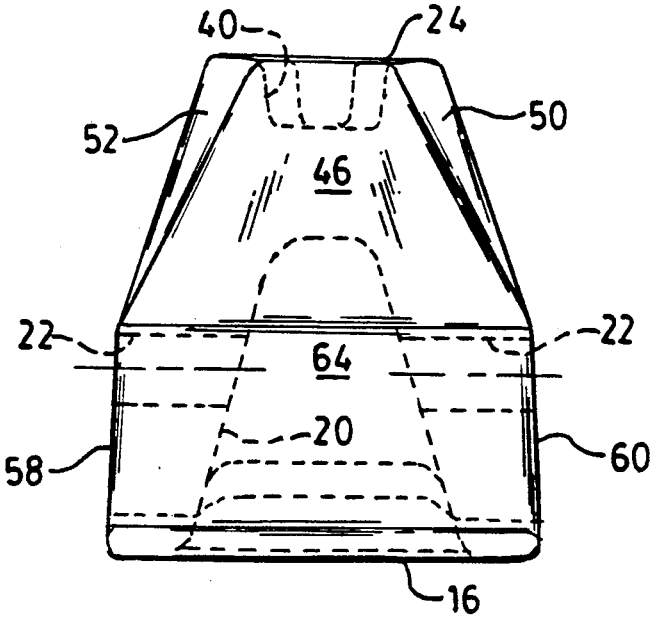
FIG. 10 is an end view of the tooth illustrated in FIG. 8.

Referring now to FIGS. 8, 9, and 10, the tooth 10 illustrated is basically the same as the tooth 10 illustrated in FIGS. 1–6 with only minor differences. All element numbers corresponding to elements in FIGS. 1–6 are common to the corresponding elements in FIGS. 8–10.

The additional side surfaces 58,60 of FIGS. 8–10 extend parallel to the longitudinal plane 18 along the entire length $L_1$ of the tooth 10 as opposed to being located only for a predetermined distance along the mid point of the length $L_1$ as set forth with respect to FIGS. 1–6. The height of the additional side surfaces 58,60 is generally the same as that set forth in FIGS. 1–6, such that, the pair of aligned holes 22, separated by the cavity 20, extend between the additional side surfaces 58,60 and intersect the plurality of side surfaces 48,52,50,54 extending from the outer surface 24. As noted with respect to FIGS. 1–6, the additional side surfaces 58,60 are considered to be perpendicular to the outer surface 24 even though in the Figures shown, they are illustrated as having draft angles provided for manufacturing purposes. All other aspects of the embodiment illustrated in FIGS. 8–10, are the same as that set forth with respect to FIGS. 1–6.

Figure 11:
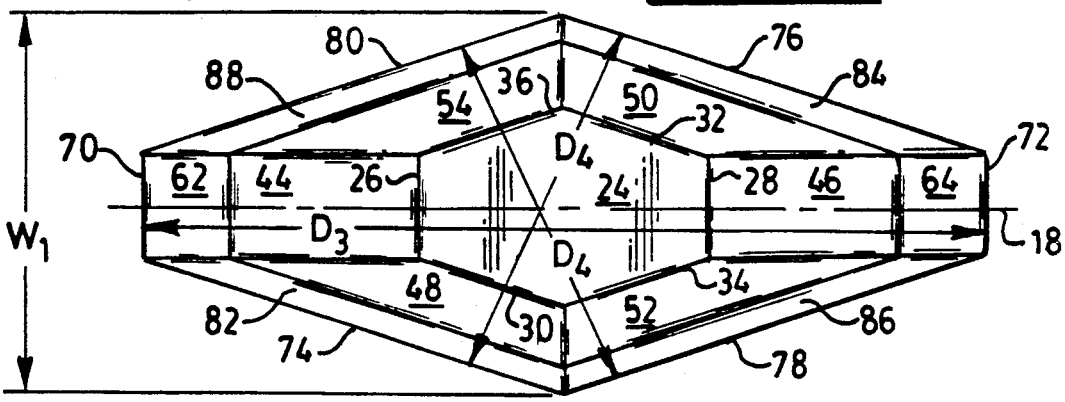
FIG. 11 is a top view of another embodiment of the present invention.
Figure 12:
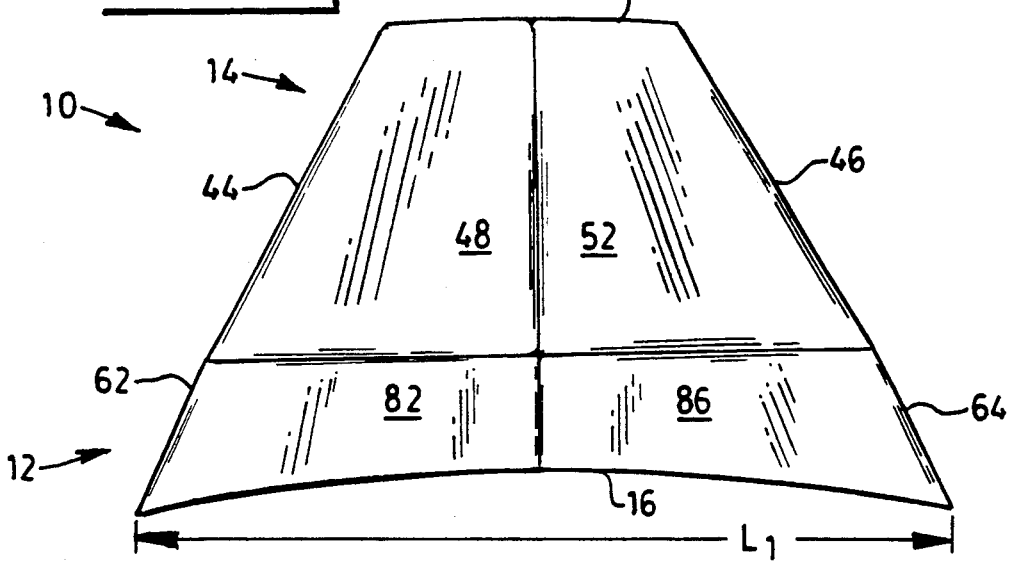
FIG. 12 is a side view of the tooth illustrated in FIG. 11.
Figure 13:
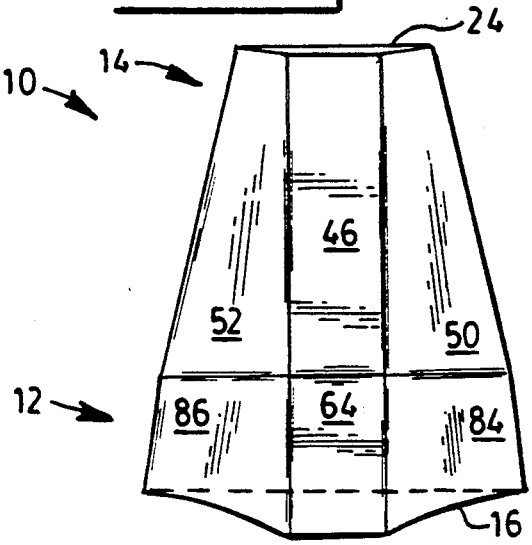
FIG. 13 is an end view of the tooth illustrated in FIG. 11.

Referring now to FIGS. 11, 12, and 13, the tooth 10 illustrates another embodiment of the present invention. Like components of FIGS. 11–13 that correspond to like components of FIGS. 1–6 have the same element numbers.

The tooth 10 illustrated in FIGS. 11–13 is adapted to be welded to the wheel of the compactor. However, it is recognized that the tooth 10 of the subject embodiment could have a cavity 20 provided as set forth with respect to FIGS. 1–6 without departing from the essence of the invention. The base 16 of the subject embodiment has at least six edges 70,72,74,76,78,80 as opposed to the generally rectangular base set forth in FIGS. 1–6. The base 16 of the subject embodiment has the same shape as the outer surface 24 and is concentrically disposed therewith. The at least six edges 70,72,74,76,78,80 of the base 16 has a first pair of opposed edges 70,72 spaced from each other a third predetermined distance $D_3$ and a plurality of other edges 74,76,78,80. The first predetermined distance $D_1$. The first pair of opposed edges 70,72 is likewise perpendicular with the longitudinal plane 18. The plurality of other edges 74,76,78,80 of the at least six edges have a second pair of opposed edges 74,76 that is spaced from each other a fourth predetermined distance $D_4$ and a third pair of opposed edges spaced from each other a distance equivalent to the fourth predetermined distance $D_4$. The fourth predetermined distance $D_4$ is less than the third predetermined distance $D_3$. The distance $D_1$ of the outer surface 24 is less than the width $W_1$ of the tooth 10.

A plurality of additional side surfaces 82,84,86,88 extend from the plurality of other edges 74,76,78,80 of the base 16 at an obtuse angle with respect to the outer surface 24 and intersect corresponding ones of the plurality of side surfaces 48,50,52,54 extending from the outer surface 24. The obtuse angle of the additional side surfaces 82,84,86,88 extending from the other edges 74,76,78,80 of the base 16 relative to the outer surface 24 is less than the obtuse angle formed by the side surfaces 48,50,52,54 extending from the other edges 48,50,52,54 of the external surface 24.

The side surfaces 44,46 extending from the first pair of opposed edges 26,28 form an angle with respect to the external surface 24 in the range of 115 degrees to 135 degrees and more preferably in the range of 120 degrees to 130 degrees.

All other aspects of the embodiments set forth in FIGS. 11–13 are the same as that set forth in FIGS. 1–6.

INDUSTRIAL APPLICABILITY

In use, each embodiment of the tooth 10 effectively penetrates the refuse material or soil being worked, effectively crushes and/or grinds and compacts the refuse material and/or soil while maintaining good traction of the compactor wheel relative to the materials being worked without disturbing the surface of the refuse material and/or soil. By having the side surfaces 44,46 that extend from the first pair of opposed edges 26,28, at an angle in the range of 115 degrees to 135 degrees, the tip portion 14 enters the refuse material and/or soil being worked and exits the refuse material and/or soil without disturbing the surface of the materials during exiting. This is quite beneficial since any disturbance of the refuse material and/or soil being worked allows the refuse material and/or soil to be eroded by wind, rain and/or other elements.

By having all of the side surfaces 44,46,48,50,52,54 extending from the at least six edges 26,28,30,32,34,36 of the external surface 24 at an obtuse angle therewith, the soil or material being worked is more effectively compacted in all directions. Furthermore, by having the plurality of side surfaces 48,50,52,54 at an angle less than 90 degrees with respect to the direction of travel, a pressure distribution is provided in the refuse material and/or soil that is wider than the width $W_1$ of the tooth 10.

The recess 40 disposed in the outer surface 24 of the tip portion 14 enhances the ability of the tooth 10 to resist slippage when being operated on hard surfaces such as frozen refuse material and/or soil. The recess 40 provides traction benefits both when the tooth 10 is new and as it wears. The reduces area of contact, provided by the recess, between the outer surface 24 and the material surface being worked provides penetration of the tip portion 14 on hard and/or frozen material. In softer materials the recess 40 fills with material and thus acts as a generally larger area to provide the necessary compaction forces. The depth of the recess 40 may be utilized as a wear gauge which indicates that once the material around the recess 40 has worn away the tooth should be replaced.

In view of the foregoing, it is readily apparent that the tooth 10 provides a tooth profile that effectively penetrates the material being worked, compacts, grinds and/or crushes the refuse material and/or soil being worked, and provides effective traction of the compactor wheel on the refuse material and/or soil being worked without disturbing the surface thereof. Furthermore, the outer profile of the tooth 10 in combination with a smaller number of teeth being required on the wheel of the compactor reduces any tendency of refuse material and/or soil collecting between the teeth of the compactor wheel.

Even though the tooth 10 has been described for use in landfill operations, it should be recognized that the tooth 10 would be likewise effective as a soil compaction tooth.

Other aspects, objects, and advantages of this invention can be obtained from a study of the drawings, the disclosure, and the appended claims.

What is claimed is:

1. A tooth adapted for use on a compactor wheel, comprising:

a body portion having a base with a predetermined length and a predetermined width, a longitudinal plane defined parallel to the length of the base; and a tip portion having an outer surface with at least six edges connected one to the other with obtuse angles formed therebetween and being spaced outwardly from the base, the at least six edges having a pair of opposed edges and a plurality of other edges, each edge of the pair of opposed edges being spaced from the other a predetermined distance and perpendicular with the longitudinal plane, a plurality of side surfaces extend at an obtuse angle relative to the outer surface one from each edge of the at least six edges towards the base.

2. The tooth of claim 1 wherein the angle of the side surfaces extending from the pair of opposed edges with respect to the outer surface of the tip portion is in the range of 115 degrees to 135 degrees.

3. The tooth of claim 2 wherein the angle of the side surfaces extending from the pair of opposed edges with respect to the outer surface is preferably in the range of 120 degrees to 130 degrees.

4. The tooth of claim 3 wherein the plurality of other edges has second and third pairs of opposed edges, each edge of the respective second nd third pairs of edges being spaced from the other at a second predetermined distance.

5. The tooth of claim 4 wherein the second predetermined distance is less than the first predetermined distance.

6. The tooth of claim 5 wherein the base has at least six edges and the at least six edges of the base has a pair of opposed edges each being spaced from the other a third predetermined distance that is greater than the first predetermined distance, each edge of the first pair of opposed edges of the base is perpendicular with the longitudinal plane, the at least six edges of the base also has second and third pairs of opposed edges each edge of the respective second and third pairs of opposed edges being spaced from the other at a fourth predetermined distance that is less than the third predetermined distance.

7. The tooth of claim 6 wherein a plurality of side surfaces extend at an obtuse angle with respect to the outer surface one from each edge of the second and third pair of edges of the base towards the outer surface, the obtuse angle of the side surfaces extending from the second and third pair of edges of the base is less than the obtuse angle of the side surfaces extending from the second and third pair of edges of the outer surface, and the plurality of side surfaces extending from the base intersect corresponding surfaces of the plurality of side surfaces extending from the outer surface.

8. The tooth of claim 7 wherein the outer surface of the tip portion has only six edges.

9. The tooth of claim 6 wherein a cavity is defined in the body portion and extends inwardly from the base.

10. The tooth of claim 9 wherein a pair of aligned holes is defined in the body portion perpendicular to the longitudinal plane and the holes of the pair of aligned holes are separated by the cavity.

11. The tooth of claim 6 wherein a recess is defined in the tip portion and extends inwardly from the outer surface thereof.

12. The tooth of claim 11 wherein the shape of the recess is generally the same shape as that defined by the at least six edges of the outer surface of the tip portion.

13. The tooth of claim 12 wherein the recess is centrally disposed in the outer surface of the tip portion.

14. The tooth of claim 13 wherein the recess forms a plurality of additional edges on the outer surface that are parallel to the corresponding at least six edges of the outer surface.

15. The tooth of claim 14 wherein the base is generally rectangular in shape.

16. The tooth of claim 15 wherein the first predetermined distance between the first pair of opposed edges of the outer surface is less than the predetermined length of the base.

17. The tooth of claim 16 wherein additional side surfaces extend from the generally rectangular base parallel to the longitudinal plane and oriented perpendicular to the outer surface of the tip portion.

18. The tooth of claim 17 wherein yet additional side surfaces extend from the generally rectangular base perpendicular to the longitudinal plane and intersect the side surfaces extending from the first pair of opposed edges of the outer surface and oriented at a second smaller obtuse angle with respect to the outer surface of the tip portion as compared to the obtuse angle of the side surfaces extending from the first pair of opposed edges of the outer surface.

19. The tooth of claim 18 wherein the respective additional side surfaces are disposed for a predetermined distance midway along the longitudinal length of the tooth and extend from the generally rectangular base for a distance less than half the distance between the base and the outer surface.

20. The tooth of claim 19 wherein the predetermined length of the additional side surfaces is less than one fourth of the predetermined length of the base.

21. The tooth of claim 20 wherein a cavity is defined in the body portion and extends inwardly from the generally rectangular base.

22. The tooth of claim 21 wherein a pair of aligned openings are defined in the body portion perpendicular to the longitudinal plane and the holes of the plurality of holes are separated by the cavity, the pair of aligned holes separated by the cavity extends between the additional side surfaces of the base.

23. The tooth of claim 22 wherein a hard particle material is disposed on the tip portion along and on both sides of the first pair of opposed edges.

* * * * *

UNITED STATES PATENT AND TRADEMARK OFFICE

CERTIFICATE OF CORRECTION

PATENT NO. : 5,217,332

DATED : June 8, 1993

INVENTOR(S) : Kazuo Takasaki, et al.

It is certified that error appears in the above-indentified patent and that said Letters Patent is hereby corrected as shown below:

Column 1, line 7: "a" should read as --as--

Column 1, line 37: "a" should read as --as--

Column 5, line 28: "a" should read as --an--

Column 5, line 52: "mean" should read as --means--

Column 6, line 14: "bas" should read as --base--

Column 6, line 50: after "tertiary" insert --flank--

Column 7, line 65: "a" should read as --at--

Column 8, line 2: "90°" should read as --90°--

Column 10, line 20, Claim 1: "i a " should read as --in a--

Signed and Sealed this

Twenty-ninth Day of March, 1994

Bruce Lehman

*Attest:*

BRUCE LEHMAN

*Attesting Officer*

*Commissioner of Patents and Trademarks*